United States Patent [19]

Hänsch

[11] Patent Number: 4,657,237

[45] Date of Patent: Apr. 14, 1987

[54] METHOD OF, AND APPARATUS FOR, PRODUCING STACKS OF FLEXIBLE FLAT PRODUCTS, ESPECIALLY PRINTED PRODUCTS

[75] Inventor: Egon Hänsch, Wetzikon, Switzerland

[73] Assignee: Ferag AG, Hinwil, Switzerland

[21] Appl. No.: 624,365

[22] Filed: Jun. 25, 1984

[30] Foreign Application Priority Data

Jul. 11, 1983 [CH] Switzerland ..... 3799/83
Feb. 20, 1984 [CH] Switzerland ..... 817/84

[51] Int. Cl.[4] ..... B65H 29/38

[52] U.S. Cl. ..... 271/178; 198/732; 271/188; 271/202; 271/215

[58] Field of Search ..... 271/178, 190, 180, 181, 271/198, 213, 214, 215, 216, 139, 140, 141, 142, 143, 202, 3.1, 177, 195, 188, 314, 209, 211; 198/462, 408, 423, 732; 414/28, 103, 106, 107, 108, 52

[56] References Cited

U.S. PATENT DOCUMENTS

| | | | |
|---|---|---|---|
| 2,796,259 | 6/1957 | Fawcett | 271/188 |
| 2,884,243 | 4/1959 | Stobb | 271/178 |
| 2,933,314 | 4/1960 | Stobb | 271/215 |
| 3,671,034 | 6/1972 | de Ridder | 271/178 |
| 3,697,064 | 10/1972 | Kummerer | 271/87 |
| 3,700,232 | 10/1972 | Wiegert et al. . | |
| 3,812,955 | 5/1974 | Kopp | 198/732 |
| 4,056,264 | 11/1977 | Dhooge et al. | 271/177 |
| 4,067,568 | 1/1978 | Irvine | 271/178 X |
| 4,240,539 | 12/1980 | Klapp | 271/216 X |
| 4,333,559 | 6/1982 | Reist | 271/202 X |
| 4,500,245 | 2/1985 | Madwell et al. | 271/277 X |

FOREIGN PATENT DOCUMENTS

| | | |
|---|---|---|
| 2421271 | 5/1974 | Fed. Rep. of Germany . |
| 3026163 | 7/1980 | Fed. Rep. of Germany . |
| 3246112 | 7/1983 | Fed. Rep. of Germany . |
| 607979 | 12/1978 | Switzerland . |
| 951225 | 3/1964 | United Kingdom . |
| 1219736 | 1/1971 | United Kingdom . |
| 1286921 | 8/1972 | United Kingdom . |
| 1580331 | 12/1980 | United Kingdom . |
| 2108935 | 5/1983 | United Kingdom . |

*Primary Examiner*—Andres Kashnikow
*Assistant Examiner*—Matthew C. Graham
*Attorney, Agent, or Firm*—Werner W. Kleeman

[57] ABSTRACT

The printed products are slid upon the rearmost printed product in order to form a stack in a lying configuration. For this purpose there is provided a conveyor having at least one circulating chain at which entraining cams are mounted in a regularly spaced relationship. The entraining cams act upon the trailing edges of the printed products. A multiple number of pressing rollers press the stack, and these pressing rollers are mounted at a support disc. The support disc is driven for rotation synchronously with the conveyor chain. Each pressing roller in succession presses upon the rearmost product of the stack. The pressing roller which acts upon the stack is always located just in front of the leading edge of the product which is slid onto the stack and the pressing roller moves upwardly conjointly with the product in the product slide-on direction thereof. While the stack is thus always under compression, the next following product can be slid onto the stack without experiencing a pressing action.

48 Claims, 9 Drawing Figures

Fig.1
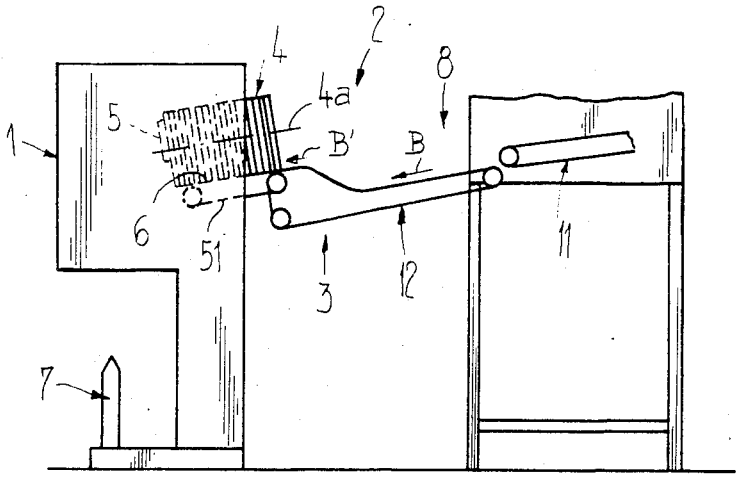
Fig.6
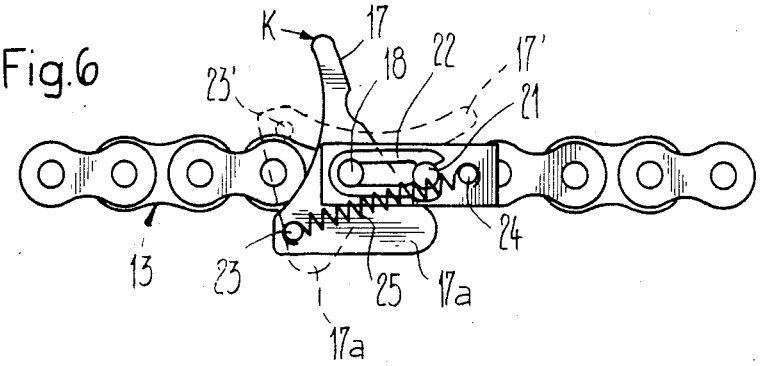
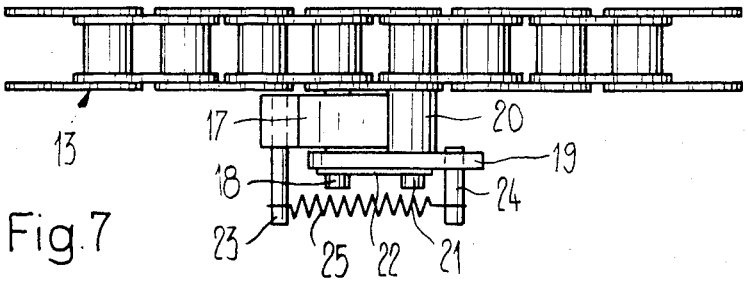
Fig.7

1
3
4
4a
5
6
8
9
9a
9b
9'
9''
9'''
10
11
12
13
13a
14(46)
15
16(47)
17
17a
26
27
27a
27'
28
28'
29
30
31
32
32a
32'
34
35
36
37
37'
38
38'
39
39'
39''
39'''
40
41
42
43
44
45
48
49
50
51
52
53
A
B
B'
C
D
E 1
10
39
38
37
D
40
3
9'
39'
50
4
9
9a
9"
C
39"
36
35
E
41
4a
9'''
32
39'''
34
B'
S
9b
9a
9
6
53
42
43
27a
13a
15
53
51
13
44
27
28
45
29
31

2
39
38
D
37
40
39'
9"
9'
50
4
9
3
36
35
C
39"
E
9a
41
4a
32
9'''
39'''
34
S
B'
17
9b
9a
9
6
17
15
53
42
51
52
13
44
43
27a
13a
17
27
12
28
45
29
31

METHOD OF, AND APPARATUS FOR, PRODUCING STACKS OF FLEXIBLE FLAT PRODUCTS, ESPECIALLY PRINTED PRODUCTS

BACKGROUND OF THE INVENTION

The present invention relates to a new and improved method of, and apparatus for, producing stacks of flexible, flat products, especially printed products.

In its more particular aspects, the present invention relates to a new and improved method of, and apparatus for, producing stacks of flexible, flat products, especially printed products, by means of which buffer stacks can be formed which serve for intermediate storage of the products and to feed the latter to further processing installations, particularly to feeders or feeding attachments.

In a method of, and apparatus for, producing stacks of products such as is known, for example, from U.S. Pat. No. 3,700,232, granted Oct. 24, 1972, the sheets or pages which arrive in an imbricated formation are taken over by conveyor bands having horizontal conveying direction and arranged in juxtaposed relationship. The products are conveyed against abutment fingers which upwardly project from the conveying path. The first product of the imbricated formation runs up onto the somewhat curved abutment fingers with the leading edge of the printed product and is upwardly deflected. The successive products then are slid upon the related rearmost product of the stack thus formed. In this manner a stack of lying or reposing configuration is formed which grows from the stationary abutment fingers towards the rear and within which the sheets or pages assume an upright position.

The stack thus formed bears upon the continuously circulating conveyor bands. Due to the contact existing between the conveyor bands and the lower edges of the stacked sheets or pages, the same are entrained which has the result that the stack is compressed on the underside thereof. This may result in a fanning of the sheets or pages on the top side of the stack. In order to reduce the friction forces between the conveyor bands and the sheets or pages, depressions are provided in the stack support and extend over part of the length thereof, the conveyor bands extending within the depressions. This measure entails a certain constructional expense and cannot completely eliminate the danger of the fanning of the stack. Due to the continuous abrading passage or sliding of the conveyor bands past the bottom edge of the stacked sheets or pages the latter may additionally become damaged. It should be noted that some frictional entrainment of the stacked sheets or pages by the conveyor bands is desired since otherwise the sheets or pages would assume a progressively more inclined position as the stack grows and would rearwardly slip off the stack.

In the method of, and apparatus for, producing stacks of products as known, for example, from German patent publication No. 2,421,271, published Nov. 28, 1974, the printed sheets which are to be stacked are fed in an imbricated formation to a stationary stacking location by means of a horizontal band conveyor. At the stacking location two deflecting fingers cause the printed sheets to be upwardly deflected at their leading edge. In order to support the deflected printed sheet there are provided support means which are displaceable in correspondence to the increase in the length of the stack and which comprise a support surface inclined at an angle of 45° relative to the horizontal. The first printed sheet is slid onto the support surface while the successive printed sheets are pushed onto the related rearmost printed sheet of the stack.

While there is no danger of a fanning of the stack due to the markedly inclined position of the stacked printed sheets, the latter tend to slip off towards the rear. In order to prevent such slip-off, stops have to be provided which, however, may cause damage to the printed sheets. Furthermore, an inclined position of the printed products at an angle of about 45° in the stack is undesired in certain cases.

SUMMARY OF THE INVENTION

Therefore, with the foregoing in mind, it is a primary object of the present invention to provide a new and improved method of, and apparatus for, producing stacks of flexible, flat products, especially printed products, which permit compact stacks to be formed without the danger of damaging the products.

Another and more specific object of the present invention is directed to a new and improved method of, and apparatus for, producing stacks of flexible, flat products, especially printed products, in which the products stand at approximately right angles relative to the longitudinal axis of the stack, especially of a stack in a lying configuration.

Now in order to implement these and still further objects of the present invention, which will become more readily apparent as the description proceeds, the method of the present development is manifested by the features that, a pressing action is exerted on the momentarily rearmost product of the stack at a location which is located in front of the leading edge of each successive or next following product or product package as seen in the product slide-on direction. The location at which the pressure is effective is displaced conjointly with such next following product or product package in the product slide-on direction thereof during the slide-on movement of such product or product package.

With respect to the apparatus for producing stacks of products, especially printed products, the apparatus of the present development is manifested by the features that, there are provided pressing means which exert a pressure on the momentarily rearmost product of the stack at a location which is placed in front of the leading edge of each next following product or product package as seen in the product slide-on direction thereof and which is conjointly displaced with such next following product or product package in the product slide-on direction during the slide-on movement of such product.

Since a pressure is continuously exerted on the stack, not however on the momentarily slid-on product, there is achieved the result that the stack is held together but the slide-on or pushing-on of the products can be performed without the application of pressure. Damage of the products during the product slide-on operation is thus avoided as well as the danger of a frictional entrainment of the rearmost product of the stack by the product which is slid onto the stack.

The products can be upwardly bent in the region of the margins or edges which extend in the conveying direction, before the products are slid onto the stack and the products thereby experience an additional stiffening or propping. There is thus prevented that the products upon which no pressure is exerted, can backwardly bend or roll in the region of their leading edge during the slide-on operation.

When the products arrive in an imbricated formation preferably packages are formed from the supplied products prior to the product slide-on operation. Two or more products rest upon each other in such packages. Such packages are inherently stiffer than single products because they are formed from a multiple number of products with upwardly bent lateral margins or edges. Additionally, there is still achieved the advantage that the danger is further reduced that the products may be upwardly pushed beyond the top side of the stack.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 1 is a side view of a feeder or feeding attachment including a supply apparatus constituting an apparatus for producing a buffer stack of products according to the invention;

FIG. 6 is a side view on an enlarged scale as compared to FIGS. 2 to 5 and shows a section of a conveyor chain including an entraining element in the apparatus as shown in FIGS. 2 to 5;

FIG. 7 is a top plan view on an enlarged scale as compared to FIGS. 2 to 5 and shows the section of the conveyor chain as illustrated by FIG. 6;

DETAILED DESCRIPTION OF THE PREFERRED EMBODIMENTS

Figure 2:
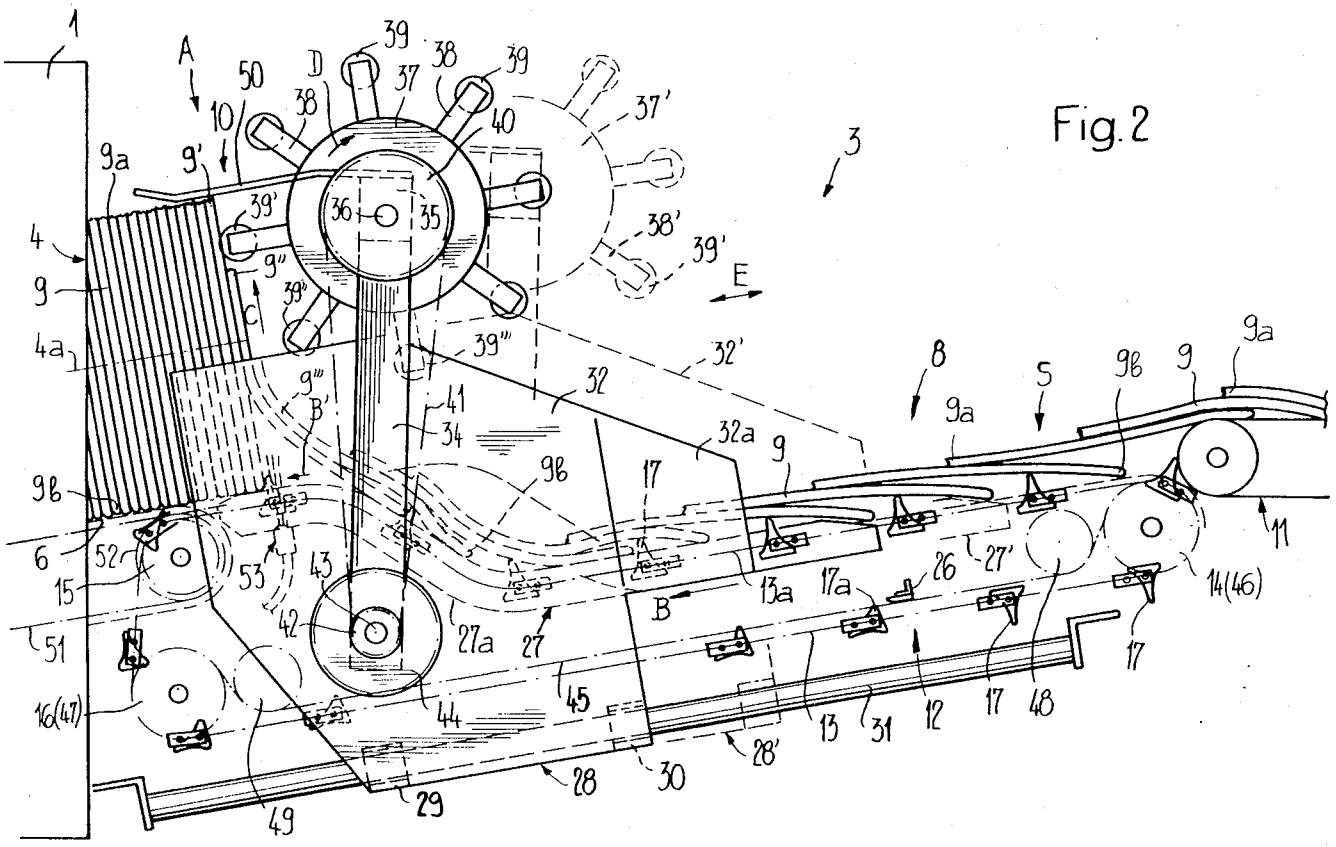
FIG. 2 is a side view on an enlarged scale as compared to FIG. 1 and shows the main part of the apparatus for producing buffer stacks as shown in FIG. 1.

Describing now the drawings, it is to be understood that only enough of the construction of the stack producing apparatus has been shown as needed for those skilled in the art to readily understand the underlying principles and concepts of the present development, while simplifying the showing of the drawings. Turning attention now specifically to FIG. 1, there has been purely schematically illustrated a feeder or feeding attachment 1 of a known type of construction. A supply device 2 is associated with the feeder or feeding attachment 1 and comprises a stack forming apparatus 3 which is only schematically illustrated in FIG. 1 and will be described hereinafter in still more detail with reference to FIGS. 2 to 7. In a manner still to be explained, a stack 4 of reposing or lying configuration or lying stack 4 is formed by means of the stack producing apparatus 3. In such lying stack 4 the products are arranged in a juxtaposed relationship. The longitudinal axis 4*a* of the lying stack 4 is somewhat inclined relative to the horizontal. This lying or reclining stack 4 is supported with its front end at an abutment or stop 5 and bears upon a support 6. FIG. 1 further shows the collector chain 7 of a gather-stitcher or a compiling or gathering apparatus, e.g. a collating device, which interconnects in known manner a number of series arranged feeder or feeding attachments. The feeder or feeding attachment 1 comprises not particularly illustrated means for withdrawing the products from the lying or reclining stack 4 and for placing the products on the collector chain 7. The construction of the stack producing apparatus 3 will now be explained in greater detail with reference to FIGS. 2 to 7.

The stack producing apparatus 3 comprises feeding means 8 which feed printed products 9 to a stacking location 10. In the present case, the printed products 9 constitute folded sheets and arrive in an imbricated formation S. In the infed imbricated formation S, each printed product 9 bears upon a preceding printed product. Consequently, in the imbricated formation S, which is supplied substantially in horizontal direction, the leading edge 9*a* of each of the printed products 9 is exposed. The trailing edges 9*b* are formed by the fold edge. The feeding means 8 comprise a band conveyor 11 which is followed by a conveyor 12 which slides the printed products 9 onto the stack 4 in a manner still to be described.

The conveyor 12 comprises two conveying elements 13 of which only one is recognizable in FIG. 1 and which constitute chains running substantially parallel and in a spaced relationship to each other. Each conveying element 13 runs around stationary sprocket wheels 14, 15 and 16, of which one sprocket wheel like, for example, the sprocket wheel 14 is driven. The conveying elements 13 define a conveying direction B, B′ which extends substantially transversely at least in the region of the stacking location 10 and substantially parallel to the longitudinal axis 4*a* of the stack 4 and thus is also somewhat inclined relative to the horizontal. The conveying direction B, B′ also extends approximately normally relative to a plane defined by a rearmost positioned product 9′ of the stack 4. Entraining elements or dogs 17 are arranged in a regularly or substantially uniform spaced relationship at each one of the conveying elements 13. As shown in FIGS. 6 and 7, each entraining or entrainment element or dog 17 is pivotably supported at a chain stud or bolt 18 which is laterally extended or prolonged at one side. The entraining elements or dogs 17 are arranged intermediate the conveying element 13 and a plate-shaped retaining element 19 which is fixedly spaced from the conveying element 13 by a spacer member 20, as shown in FIG. 7.

The spacer member 20 is pushed onto an also laterally projecting chain stud or bolt 21. The retaining element 19 is secured in its position at the chain studs or bolts 18 and 21 by means of a securing clamp 22. At the entraining element or dog 17 as well as at the retaining element 19 there is mounted a pin 23 and 24, respectively. A tension spring 25 is arranged intermediate the two pins 23, 24 and holds the entraining element or dog 17 in its entraining position in which the entraining element or dog 17 abuts a not particularly illustrated abutment and projects upwardly. When a sufficiently large force is exerted on the entraining element or dog 17 in the direction of the arrow K, as shown in FIG. 6, the same is pivoted and after passing through a pivot or toggle point under the action of the tension spring 25 pivots into an inactive position which is shown in dashed lines in FIG. 6. Resetting means or a reset abutment 26 is present as shown in FIG. 2 in order to reset the entraining element or dog 17 into the entraining position and a projection 17*a* of the entraining element or dog 17 coacts with the reset abutment 26.

The conveying elements 13 are guided in the region of their conveying-active run or strand 13*a* at a guide member 27 which is designed in a substantially S-shape as will be evident from FIG. 2 and which comprise an ascending section 27*a* which ascends towards the stacking location 10. The guide member 27 forms part of a slide or carriage 28 which is displaceably guided along two guide means or rails 31 by means of roller bearings 29, 30. Only one of the guide rails 31 is visible in the drawings. The slide 28 further comprises two side walls 32 and 33 which are arranged at a distance corresponding to the width of the printed products 9. The side walls 32, 33 are adjustable with respect to their distance for adaptation to different product widths. At their infeed end 32*a* the side walls 32, 33 are outwardly angled to some extent.

Figure 5:
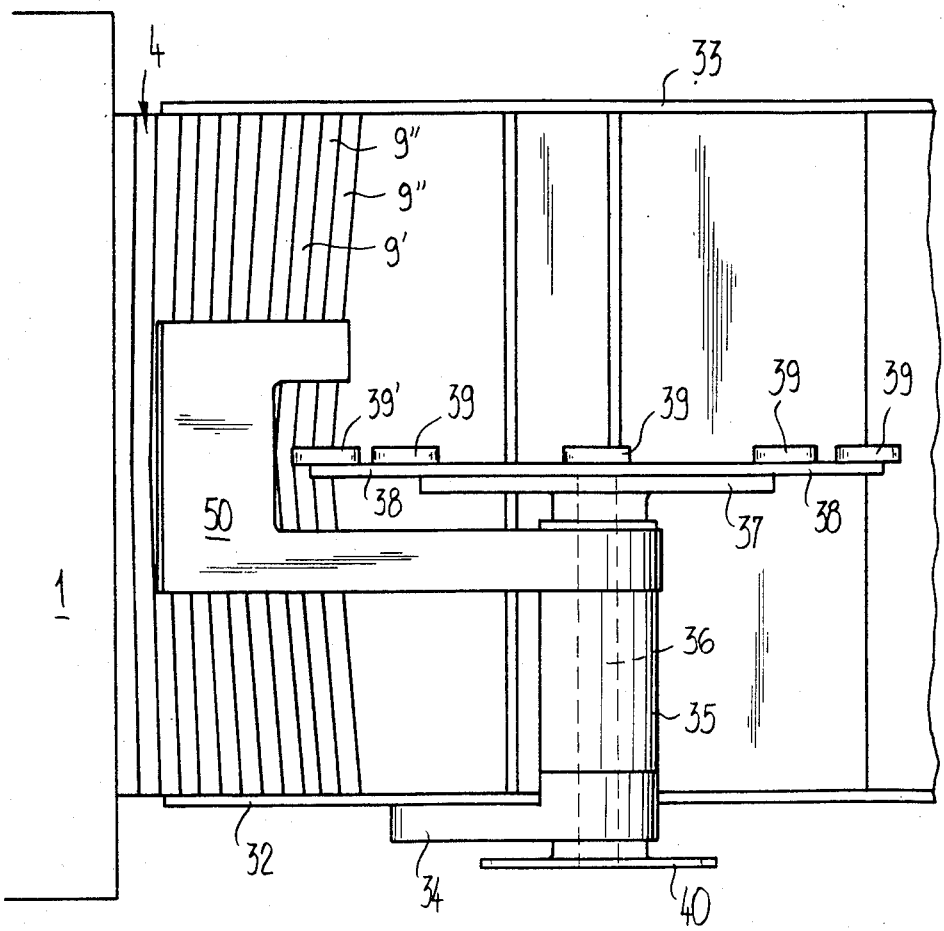
FIG. 5 is a top plan view of the stack producing apparatus as shown in FIG. 2 looking in the direction of the arrow A in FIG. 2 and on an enlarged scale as compared to FIG. 2.

An upwardly extending arm 34 is mounted at the one side wall 32 and supports a bracket or cantilever 35 extending in the direction towards the opposite side wall 33, as shown in FIG. 5. A shaft 36 is journaled in the bracket 35 and a carrier or support disc 37 is mounted at one end of the shaft 36. Pressing means comprise arms, for instance comprise eight radially extending arms 38, and at the carrier or support disc 37 the arms 38 are arranged at equal angular distances. These arms 38 project beyond the carrier or support disc 37 and carry pressing elements or rollers 39 of the pressing means and which are freely rotatably journaled at their projecting ends. At the end of the shaft 36 which is opposite the carrier or support disc 37 there is mounted a sprocket wheel 40 about which extends a drive chain 41 which meshes with a further sprocket wheel 42. The further sprocket wheel 42 is fitted to a shaft 43 carrying a second sprocket wheel 44. The latter is engaged with a drive chain 45 which is guided at sprocket wheels 46 and 47 and which is engaged with further sprocket wheels 48 and 49. The two sprocket wheels 46 and 47 are arranged at the same shaft as the sprocket wheels 14 and 16 over which the conveying elements 13 run. The drive chain 45 is driven for circulation or revolving motion by the sprocket wheel 46. The drive chain 45 drives the carrier or support disc 37 for revolving along a circular path of revolution in the direction of the arrow D via the sprocket wheels 44, 42, the chain 41 and the sprocket wheel 40. The pressing elements or rollers 39 thus are also displaced in the direction of the arrow D along a circularly arcuate-shaped path of revolution.

The pressing means 37, 38 and 39 and the guide member 27 are thus arranged at the slide 28 and are displaceable conjointly therewith. The slide 28 is guided at the guide means or rails 31, 32 which descend towards the stack 4. The pressing means 37, 38 and 39 press against an end of the stack 4, preferably under the action of gravity, and which end is opposite to the end at which the stack is supported.

Abutment or stop means 50 forming a sheet metal abutment are further mounted at the bracket or cantilever 35 and extend at a distance from the stack support 6. This distance approximately corresponds to the height of the stack 4 in order to limit the displacement of the printed products in the predetermined product slide-on direction C.

There is furthermore purely schematically illustrated in the figures of the drawing a drive chain 51 which extends into the feeder or feeding attachment 1. The drive chain 51 is guided at a sprocket wheel 52 which is fitted to the same shaft as the sprocket wheel 15 for the conveying element 13. Components of the feeder or feeding attachment 1 are driven by means of the conveyor 12 via this drive chain 51.

Figure 3:
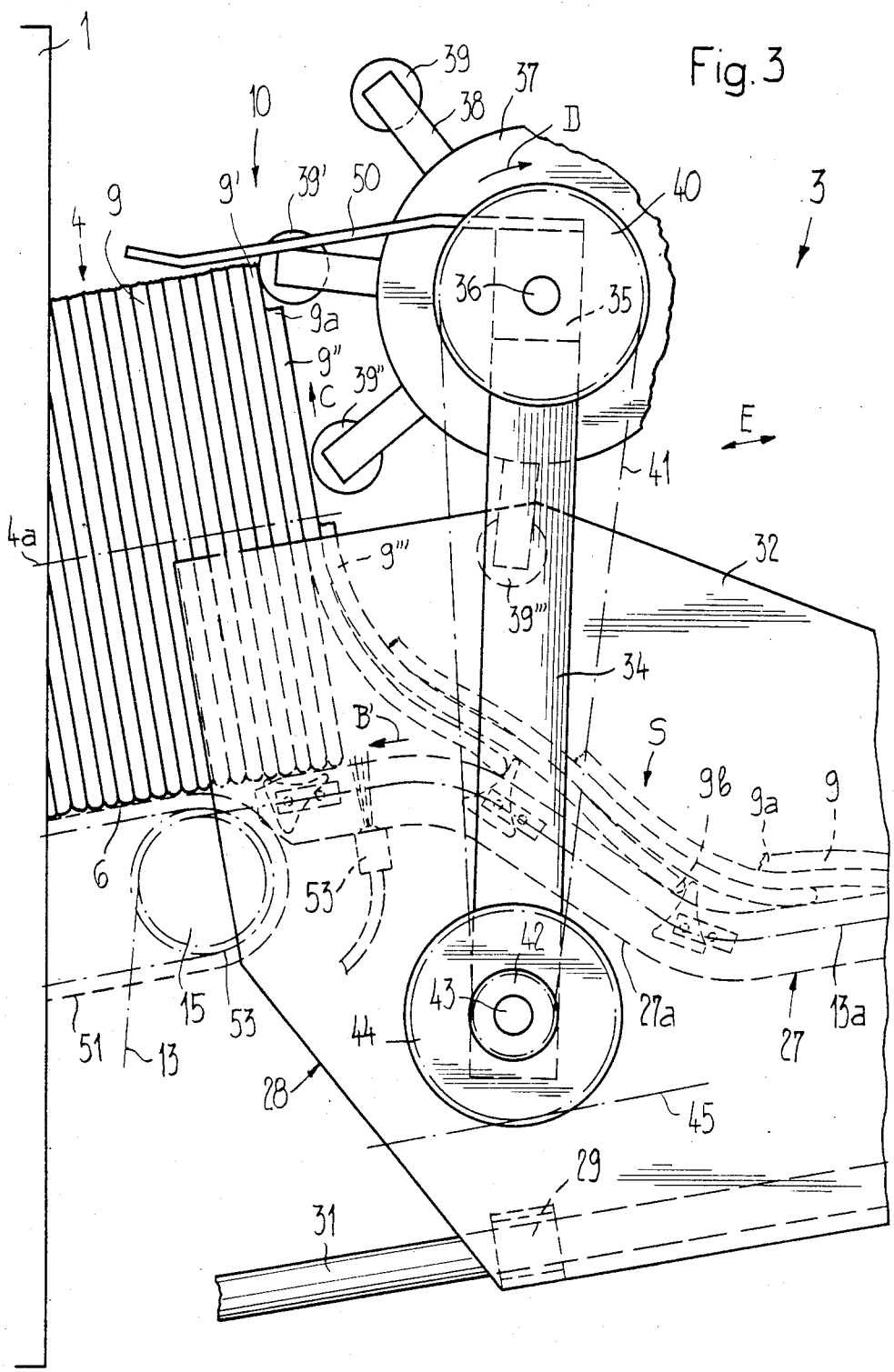
FIGS. 3 and 4 illustrate on an enlarged scale as compared to FIG. 2 the region of the stacking location in the apparatus as shown in FIG. 2 at successive instances during the product slide-on operation.

There is further shown in FIGS. 2 to 4 blowing means comprising an air blowing nozzle 53 which is arranged below the stack support 6 in the region of the stacking location 10. The air leaving the air blowing nozzle 53 enters the intermediate space between the rearmost or rearmost positioned product 9' of the stack 4 and the successive or next following slid-on product 9''. The air blowing nozzle 53 is mounted at the slide 28 and displaceable conjointly therewith. Instead of a single air blowing nozzle 53 there can also be provided a multiple number of nozzles which are distributed across the width of the stack 4.

The mode of operation of the stack producing apparatus described hereinbefore will now be explained especially with reference to FIGS. 2 to 4.

For reasons which will have to be reverted to hereinafter, one of the pressing rollers 39 always engages the momentarily rearmost product 9' of the stack 4. Due to the rotation of the carrier or support disc 37, the location at which the pressing element or roller 39 engages such rearmost printed product 9' migrates or travels upwardly. Due to the inclined position of the slide 28 which is displaceable in the direction of the arrow E, the slide 28 tends to move downwardly along the guide rail 31, i.e. to the left in FIGS. 2 to 4. The passing element or roller 39 which momentarily engages the stack 4 at the center thereof exerts a pressing force on the stack 4 which causes at least the rearmost printed products 9 of the stack 4 to assume a slight V-shape as will be evident from FIG. 5. Such V-shape, inter alia, results in a stiffening or propping of the printed products 9. Due to such stiffening or propping, there is less danger for the printed products 9 to be rearwardly bent when eventually abutting the abutment or stop means 50.

The printed products 9 which are infed by the band conveyor 11 approximately in horizontal direction and preferably in an imbricated formation S are taken over by the conveyor 12 which conveys the printed products 9 along a conveying path to the stacking location 10. At this stacking location 10 the printed products 9 are slid onto the momentarily rearmost product 9' of the stack 4 in a predetermined slide-on direction indicated by the arrow C. During this product slide-on operation, the printed products 9 must be upwardly deflected by approximately 90° with respect to their infeed direction, i.e. to the conveying direction of the band conveyor 11. The deflection is effected not at once but in two steps. A first deflection takes place during transition into the ascending section 27*a* of the guide member 27 which defines an ascending part of the conveying path defined by the conveyor 11. A second deflection occurs when the printed product runs up on the rearmost printed products 9' of the stack 4. In this manner there is avoided that the entire 90°-deflection has to occur at the stacking location 10.

The transport of the printed products 9 which are taken over by the conveyor 12 is effected by the entraining elements or dogs 17 which come to act upon the trailing edges 9*b* of the printed products 9 in the course of the conveying path. It is not absolutely necessary that the band conveyor 11 supply the printed products 9 in a phase-correct position relative to the entraining elements or dogs 17. Those printed products 9 which cannot be entrained by an entraining element or dog 17 during take-over by the conveyor 12, slip back to abut an entraining element or dog 17 as soon as such products are bent into an upright position. It is thus ensured that the printed products 9 are slid or pushed onto the stack 4 in predetermined distances or spacings which are defined by the entraining elements or dogs 17.

The slide-on of the printed products 9 at predetermined distances and the distances between the pressing elements or rollers 39 which are adapted to the predetermined distances between the printed products 9 as well as the synchronous drive of the conveying elements 13 and the carrier or support disc 37 carrying the pressing elements or rollers 39 now ensure that during the slide-on of a successive printed product 9'' the pressing element or roller 39' presses upon the rearmost printed product 9' of the stack 4 at a pressing location just in front of the leading edge 9*a* of the slid-on or successive printed product 9''. The pressing location is upwardly displaced conjointly with the last-mentioned printed product 9'' in the product slide-on direction C thereof. This will be evident from FIGS. 2, 3 and 4 which illustrate the slide-on operation at three successive instants. Therefore, pressure is continuously exerted by a pressing element or roller 39 on the rearmost printed product 9' during the slide-on operation while the successive or next following printed product 9'' can be slid on without being subjected to the action of pressure.

Figure 4:
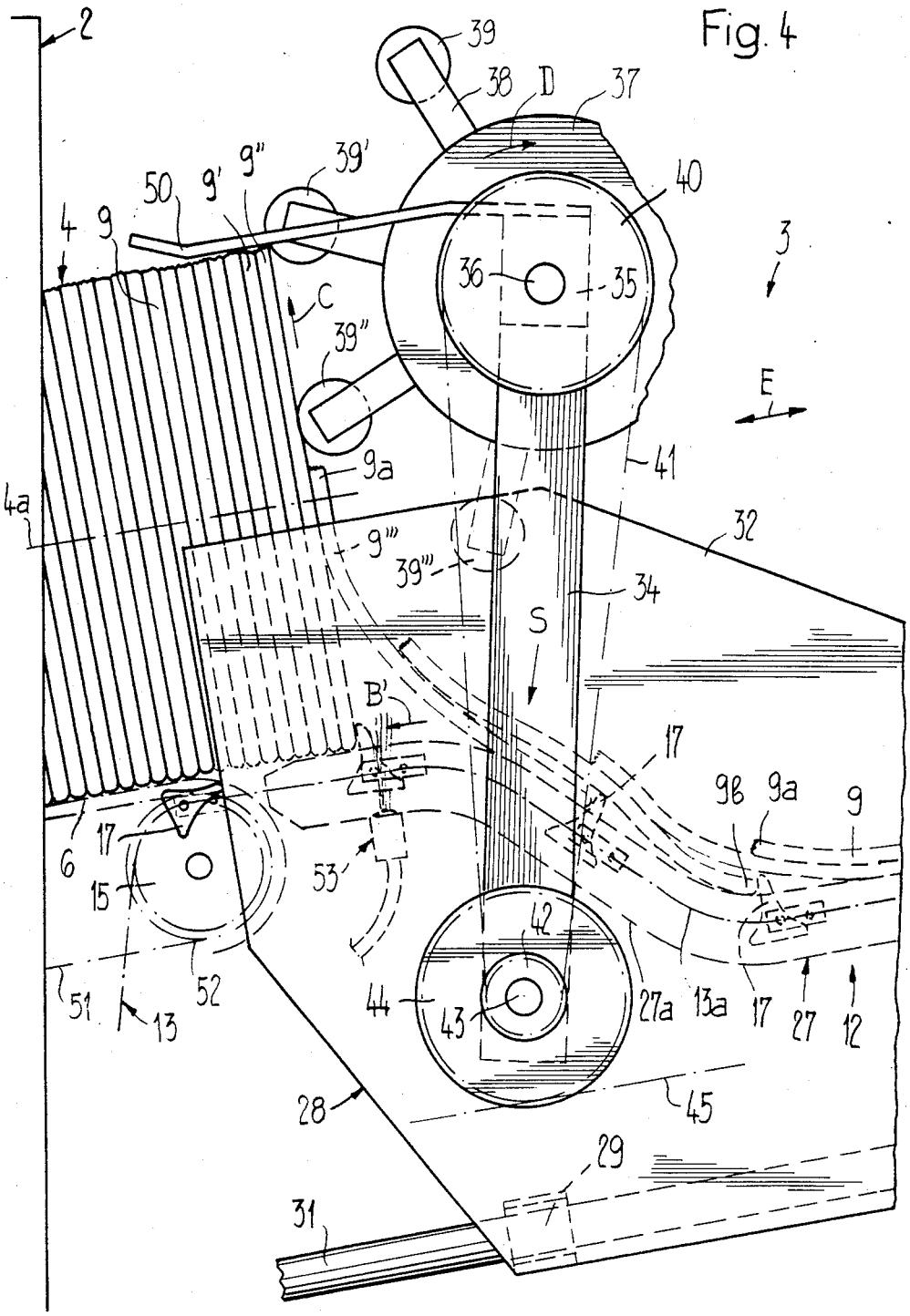

When the slid-on printed product 9'' arrives at its end position, as shown in FIG. 4, the next following pressing roller 39'' engages the just slid-on and now rearmost positioned printed product 9''. As already explained, this pressing element or roller 39'' now upwardly travels conjointly with the next following printed product 9'''.

The stack 4 which, as already mentioned hereinbefore, engages a stationary abutment 5 with its front end, as shown in FIG. 1, thus is permanently subjected to a compression. A fanning of the stacked printed products 9 is thus prevented. Since the printed products 9 are not pressed against the stack 4 during the product slide-on operation, even thin products are not damaged during this operation. Furthermore, it is prevented that the slid-on printed product 9'' entrains the rearmost printed product 9' in an upward direction due to friction between the two printed products. Should this nevertheless occur in certain cases, the abutment or stop means 50 prevent a further frictional entrainment of such rearmost printed product 9'. By blowing air into the intermediate space between the rearmost printed product 9' and the slid-on or successive printed product 9'' by means of the air blowing nozzle 53 it can be prevented to a large extent that the two printed products 9' and 9'' engage each other during the product slide-on operation at such a close contact that frictional entrainment occurs. Depending upon the kind of printed products 9 to be stacked and their surface properties, the abutment or stop means 50 and/or the air blowing nozzle 53 may be omitted.

It will be evident that the stacking location or position 10 is rearwardly displaced as the stack 4 grows, i.e. with each further slid-on printed product 9. This also implies that the slide 28 and the pressing means have to rearwardly move in the direction of the arrow E. Such movement occurs automatically by rearwardly forcing the slide 28 during each run-up of a pressing roller 39 on a printed product 9'' which has just been slid or pushed onto the stack 4. Conjointly with the slide 28 there is also rearwardly moved the guide member 27 for the conveying elements 13, so that the ascending section 27*a* of the guide member 27 always assumes the same position relative to the end of the stack 4. The guide member 27 and the pressing means 37, 38 and 39 are synchronously displaced in the longitudinal direction of the stack 4.

As will be evident from FIGS. 2 and 4, the entraining elements or dogs 17 act upon the trailing edge or margin 9*b* of the printed products 9 until such trailing edge or margin 9*b* is completely slid onto the stack 4. Since the entraining elements or dogs 17, however, are still moved on in a direction B' which extends substantially normally to the plane of the rearmost printed product 9'' of the stack 4, the stack 4 exerts a force on the entraining elements or dogs 17 in the direction of the arrow K, as shown in FIG. 6. This force, as already mentioned, causes the entraining elements or dogs 17 to pivot back after overcoming a dead-center or toggle position. In such backwardly pivoted position the entraining elements or dogs 17 cannot act upon the lower edge of the stacked printed products 9 during their further movement below the stack 4. It is thus effected that the lower edges 9*b* of the stacked printed products 9 are pressed against the stack 4 while damaging of such lower edges by the entraining elements or dogs 17 is prevented. During their return run the entraining elements or dogs 17 are upwardly repivoted into their entraining position by a reset stop 26, as shown in FIG. 2.

During the formation of a stack 4 as described hereinbefore and which, as already previously mentioned, serves as a buffer stack for feeding the feeder or feeding attachment 1, the printed products 9 are withdrawn from the front end of the stack 4. This means that depending on the ratio between the withdrawing speed and the stacking speed the stack 4 becomes greater or smaller. It is possible due to this buffer stack that the feeder or feeding attachment 1 can also operate during a time span during which the supply of printed products 9 via the band conveyor 11 is interrupted.

The upward push on the printed products 9 by means of the entraining elements or dogs 17 and the pressing of the printed products 9 due to the pressing rollers 39 which are driven to synchronously circulate with the rate of movement of the entraining elements or dogs 17 not only enables trouble-free stacking when the printed products 9 have unequal distances within the imbricated formation S, but also when there are gaps in the imbricated stream. For the same reason it is also possible to unproblematically stack flat products which would not necessarily have to be printed products and which do not arrive in an imbricated formation.

Different parts of the stack producing apparatus 3 can be constructed differently from those illustrated. Only a few such possible variants are mentioned in the following description.

The force by which the pressing rollers 39 press against the stack 4 may be increased by mounting an additional weight at the slide 28 which, for example, can be lifted or lowered conjointly with the movement of the slide 28. It will be self-evident that still other means can be employed to generate the desired pressing force.

The automatic displacement of the slide 28 as described hereinbefore has the advantage that no additional means are required for the slide displacement. However, it is also conceivable to provide control means for controlling the slide movement. A possible construction of this type has a carrier or support disc 37 which is not fixedly connected to the slide 28 but to a pivotably supported lever. With the changing size of the stack 4 there will also change the position of the carrier or support disc 37 and thus also the pivot position of the lever. This pivot position can be utilized to control the slide displacement.

It will be self-evident that when using the stack producing apparatus 3 as described hereinbefore there can be formed not only buffer stacks which serve for feeding or supply of feeders or feeding attachments and other processing installations. Using the same stack producing apparatus and working in accordance with the techniques described hereinbefore there can also be produced stacks which are not simultaneously disassembled at the other end thereof during the slide-on operation of the printed products but which also can either be further processed as a stack or which are disassembled for further processing of the individual products at a different location after possible intermediate storage.

It will be understood that the stacking location 10 can also be stationarily arranged which then requires that the support located at the other end of the stack must be alterable in its position. In such a construction, then, it is not required to provide a displaceable slide 28.

Particularly when processing thin printed products it may occur in the stack producing apparatus as described hereinbefore that such printed products during the product slide-on operation rearwardly bend or roll or curl in the region of their front edge. Such may result in product buckling or other product damage which may have disadvantageous effects during the following diassembly of the stack as well as during the subsequent further processing of the printed products. Furthermore, it is possible that despite the abutment or stop means 50 present at the stacking location 10 of the printed products 9 and extending along the top side of the stack 4, some printed products 9 may be excessively upwardly pushed and therefore project beyond the stack 4. Such printed products later cause malfunction during the diassembly of the stack. Such disadvantages can be avoided using the second embodiment of the apparatus as illustrated in FIGS. 8 and 9.

Figure 8:
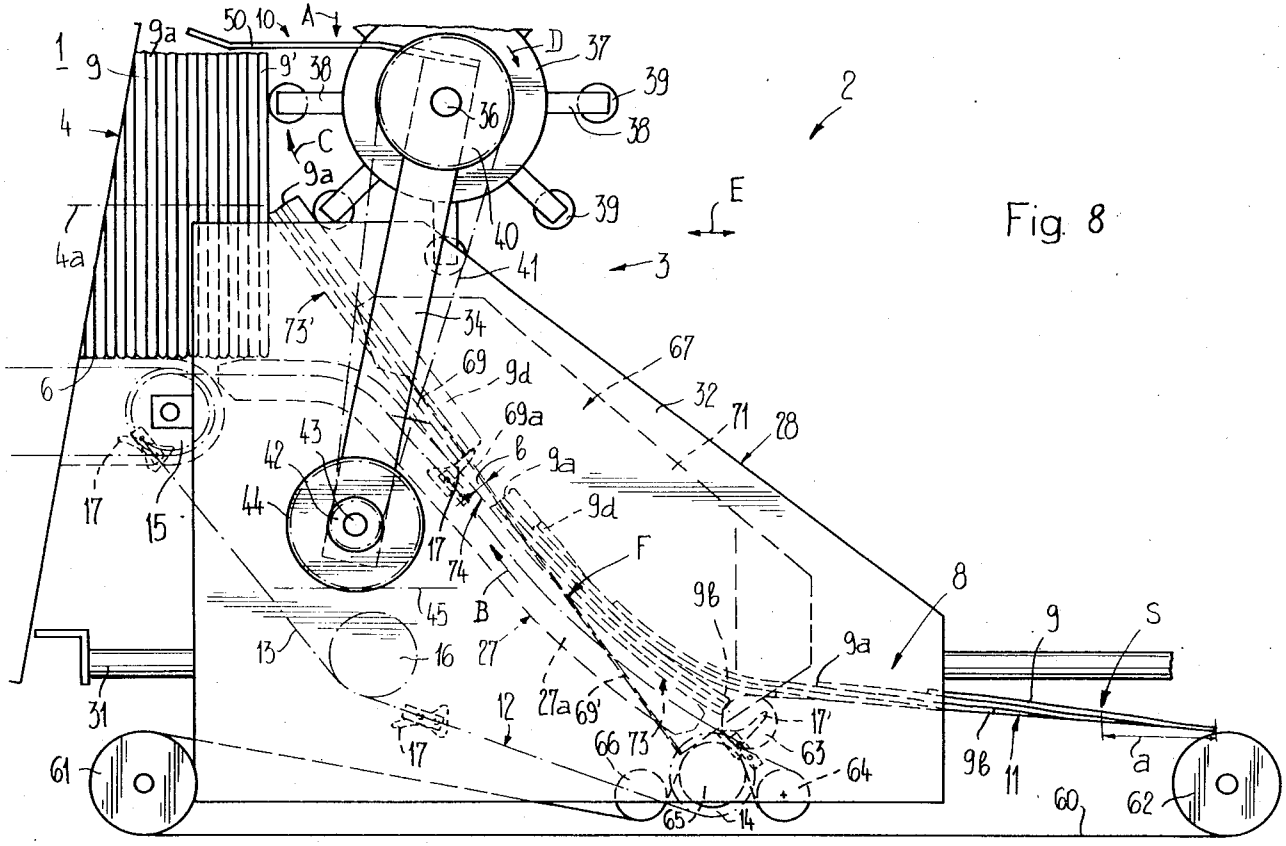
FIG. 8 is a side view corresponding to FIGS. 2 to 4 and shows the main part of a further embodiment of an apparatus for producing a buffer stack of printed products.
Figure 9:
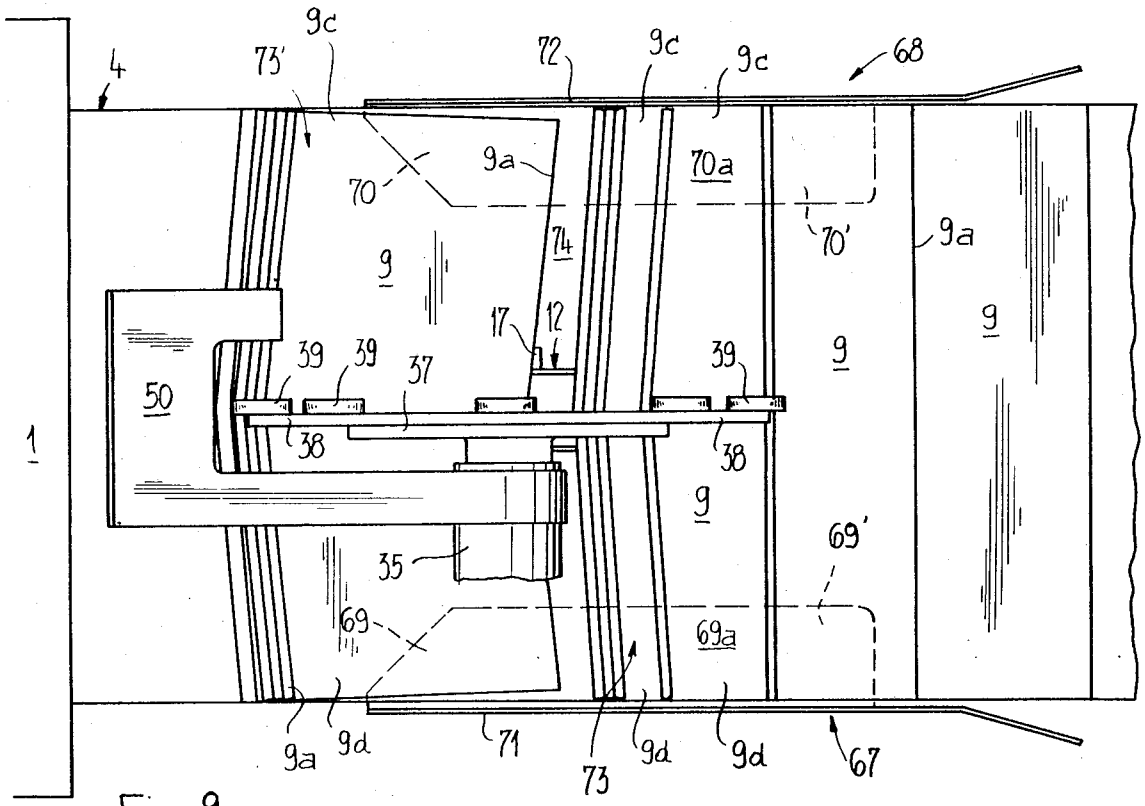
FIG. 9 is a top plan view of the stack producing apparatus as shown in FIG. 8 on an enlarged scale as compared to FIG. 8 looking in the direction of the arrow A in FIG. 8.

The stack producing apparatus according to FIGS. 8 and 9 extensively corresponds to the stack producing apparatus illustrated in FIGS. 1 to 7. The stack producing apparatus designated by reference character 3 in FIG. 8 forms part of a feeding apparatus 2 for a feeder or feeding attachment 1 of known construction. By means of this stack producing apparatus 3, a stack 4 of reposing or lying, i.e. reclining, configuration is formed in a manner still to be described and the longitudinal axis 4*a* of the stack 4 is somewhat inclined relative to the horizontal. This stack 4 is supported at its front end (not shown) and further bears upon a support 6.

The stack producing apparatus 3 comprises feeding means 8 which feeds printed products 9 which arrive at an imbricated formation S to a stacking location 10. In the arriving imbricated formation S each printed product 9 bears upon a preceding printed product so that the front edge 9*a* of each one of the printed products 9 is exposed. The feeding means 8 comprise a band conveyor 11 which is followed by a further conveyor 12 which pushes or slides the printed products 9 onto the stack 4 in a manner still to be described. This conveyor 12 comprises two conveying elements 13 which are designed as chains extending parallel to each other and in a spaced relationship. Only one conveying element 13 can be recognized to FIG. 8. Each conveying element 13 runs over stationary sprocket wheels 14, 15 and 16, of which the sprocket wheel 14 is driven in a manner still to be described. Entraining elements or dogs 17 are arranged at each conveying element 13. The distance between the entraining elements or dogs 17 is greater than the distance a between two successive printed products 9 in the imbricated formation S. In the presently described embodiment the distance between the entraining elements or dogs 17 is about the threefold of such distance a. In their structure, the entraining elements or dogs 17 correspond to the entraining elements or dogs 17 shown in FIGS. 2 to 4 as well as FIGS. 6 and 7 and they are also pivotably mounted at the conveying elements 13.

In the region of their conveying-active runs or strands 13*a*, the conveying elements 13 are guided in a guide member 27 comprising an ascending section 27*a* which ascends towards the stacking location 10, as shown in FIG. 8. This ascending section 27*a* simultaneously serves as a support for the center portion of the printed products 9. The guide member 27 forms part of a slide 28 which is guided for longitudinal displacement along two guide rails 31 in a manner not particularly illustrated. In FIG. 8 only one of the guide rails 31 is visible. The slide 28 further comprises two side walls which have been omitted from FIG. 9 and of which only the one side wall 32 is visible in FIG. 8.

An upwardly extending arm 34 is mounted at the side wall 32 and carries a bracket or cantilever 35, as shown in FIG. 9. A shaft 36, see FIG. 8, is journaled in the bracket 35 and a carrier or support disc 37 is mounted at one end of the shaft 36. Eight radially extending arms 38 are mounted at this carrier or support disc 37 and are arranged at equal angular distances. Not all of the arms 38 are illustrated in FIG. 8. At their projecting ends the arms 38 support freely rotatably journaled pressing elements or rollers 39. At the end of the shaft 36 which is opposite the carrier or support disc 37 a sprocket wheel 40 is mounted at the shaft 36. A drive chain 41 runs over the sprocket wheel 40 and engages a sprocket wheel 42 at the other end of the arm 34. The sprocket wheel 42 is fitted to a shaft 43 which supports a second sprocket wheel 44. The latter is in engagement with a drive chain 45 appropriately driven in a manner not particularly illustrated. The carrier or support disc 37 is driven for rotation in the direction of the arrow D by the drive chain 45.

Abutment or stop means 50 are further mounted at the bracket 35 and extend at a distance from the stack support 6 which distance approximately corresponds to the height of the stack 4.

The band conveyor 11 as well as the contiguous conveyor 12 differ somewhat in their construction from the band conveyor 11 and the conveyor 12, respectively, of the embodiment as shown in FIGS. 2 to 7. The band conveyor 11 comprises a conveyor band 60 which is guided at a drive wheel 61 as well as at a stationarily supported deflection wheel 62. The conveyor band 60 further extends over deflection wheels 63, 64, 65 and 66 which are all supported at the slide 28. The deflection wheel 65 if fitted to the same shaft as the sprocket wheels 14 by means of which the conveying elements 13 of the conveyor 12 are guided. The deflection wheel 65 and conjointly therewith also the sprocket wheels 14 are driven via the conveyor band 60 which is driven for circulation or revolving motion.

On both sides of the guide member 27 there are arranged two angle profiles 67 and 68 in the path of movement of the printed products 9. The angle profiles 67 and 68 are also mounted at the slide 28. The one leg of each of the angle profiles 67 and 68 constitute bending means comprising related lateral guide elements 69, 70 which are arranged in the path of movement of the printed products 9 and act upon the lateral margins or edges **9*c* and 9*d* of the printed products 9 which extend in the conveying direction of the conveyor 11. Each one of the guide elements 69 and 70 comprising a guiding surface 69*a* and 70*a*, respectively, which can be arranged to act on the margins 9*c*, 9*d* in order to upwardly bend the same. The other leg of the angle profiles 67, 68 is constructed as a lateral register wall 71 and 72, respectively. The guiding element 69 and 70 also ascend towards the stack 4. The slope of these guiding elements 69, 70, however, is greater than the slope of the ascending section 27*a*. As shown in FIG. 8, the initial sections 69', 70' of the guide elements 69, 70 are placed at a lower level than the top side of the ascending section 27*a*. Approximately at a location which is designated by the reference character F the guiding elements 69, 70 extend at the same level as the top side of the ascending section 27*a* and thereafter the guiding elements 69, 70 extend above the latter. In FIG. 8, reference character b designates the distance by which the guiding elements 69, 70 are arranged above the top side of the ascending section 27*a***.

The mode of operation of the second embodiment of the stack producing apparatus illustrated by FIGS. 8 and 9 corresponds to the mode of operation explained hereinabefore with reference to FIGS. 2 to 7 and is as follows:

The printed products 9 are supplied by the band conveyor 11 approximately in horizontal direction in a roof-tile-like configuration or imbricated formation, are upwardly deflected by the ascending section **27*a* and pushed in the direction of the arrow B towards the stacking location 10. Approximately at the location designated by the reference character F the guide elements 69, 70 start to act upon the lateral margins 9*c* and 9*d* of the printed products 9 which implies that such lateral margins 9*c* and 9*d* are upwardly bent relative to the central portion of the printed products 9. The slope angle of the ascending section 27*a* is selected to be so great that the individual printed products 9 slip back again until they abut at a start position of the ascending part of the conveying path defined by the conveyor 11 with their trailing edges 9*b* either at the deflecting wheel 63 for the conveyor band 60 which serves as a stop means at or an entraining element or dog 17 of the conveyor 12. Since the distance between the entraining elements or dogs 17 is about three times the distance between successive printed products 9 in the imbricated formation S, there are pre-assembled along the ascending section 27*a* packages 73 and 73' each of which comprises three printed products 9. Each package is then caught by a related entraining element or dog 17 at the trailing edges 9*b* of the printed products 9 and pushed in the direction of the arrow C onto the stack 4. In the case of the package designated by the reference numeral 73 the three printed products 9 which form this package 73 have slipped back to such an extent that their trailing or rear edge 9*b* abuts the deflection wheel 63. This package 73 will be caught at a later time by the entraining element or dog designated with the reference numeral 17' and will be upwardly pushed along the guide member 27. During this forward movement of the package 73 the lateral edges or margins 9*c* and 9*d* of the printed products 9 of this package 73 are upwardly bent by the guiding elements 69, 70, while the central portion of the printed products 9 of this package 73 bears upon the ascendong section 27*a*. The printed products 9 of each package 73, 73'** thus are bent approximately to a U- or V-shape and thereby a stiffening effect is achieved.

Due to the fact that the printed products 9 experience stiffening by the upward bending of their lateral margins **9*c* and 9*d* and that the printed products 9 are not individually pushed onto the stack 4 but in packages, it can be effectively prevented that the printed products 9 roll or curl or bend backwards during the product slide-on operation. Thus, also thin products having relatively low inherent stiffness can be slid or pushed onto the stack 4** without difficulties and without damage.

The packages 73, 73' are formed due to the sliding back of the printed products 9 in the region of the ascending section **27*a*. It is achieved thereby that an intermediate space 74 is formed between two successive packages 73 and 73' into which the entraining elements or dogs 17 extend. It can thus be avoided that the printed products 9 bear upon the entraining elements or dogs 17 which project over the top side of the guide member 27. Thus, the entraining elements or dogs 17 can be constructed sufficiently high to ensure reliable entrainment of the printed product packages 73, 73'**.

During the slide-on operation of the printed product packages 73, 73' a pressing element or roller 39 acts upon the momentarily rearmost printed product 9' of the stack 4 and moves upwardly conjointly with the slid-on package 73' in the slide-on direction C thereof as has been previously explained in detail with reference to FIGS. 2 to 7. With increasing size of the stack 4, i.e. with each further slid-on printed product package 73, the stacking location 10 is rearwardly displaced. As already mentioned, the slide 28 must follow such movement of the stacking location 10, i.e. the slide 28 is displaced towards the right in the direction of the arrow E in FIG. 1.

It may be advantageous to form the conveyor band 60 by a multiple number of individual bands which are arranged to extend in juxtaposition in a mutually spaced relationship.

While there are shown and described present preferred embodiments of the invention, it is to be distinctly understood that the invention is not limited thereto, but may be otherwise variously embodied and practiced within the scope of the following claims. Accordingly,

What is claimed is:

1. A method of producing reclining stacks of flexible, substantially flat products, especially printed products, and having a longitudinal axis extending at most at a slight inclination to the horizontal, comprising the steps of:

successively sliding the products upon each other in order to form a substantially immobile reclining stack defining a rearmost positioned product of said reclining stack and during such operation, sliding a next following product defining a leading edge upon each said rearmost positioned product of said reclining stack in a predetermined upwardly directed product slide-on direction;

during said step of sliding on each said next following product, pressing said reclining stack at each said rearmost positioned product of said reclining stack and at a pressing location which is located in front of said leading edge of said next following product in said predetermined upwardly directed product slide-on direction; and displacing said pressing location conjointly with each said next following product as the next following product is slid upon said rearmost positioned product of said reclining stack in said predetermined upwardly directed product slide-on direction.

2. A method as defined in claim 1, further including the step of: forming said lying stack at an inclination relative to the horizontal.

3. The method as defined in claim 1, further including the steps of:

infeeding in substantially horizontal direction the products to be slid upon each other for stacking; and defining the products for stacking the same.

4. The method as defined in claim 3, wherein: the step of infeeding the products in substantially horizontal direction includes the step of feeding said products in an imbricated formation.

5. The method as defined in claim 3, wherein: the step of deflecting said products includes the step of upwardly deflecting the same for performing the step of sliding each said next following product upon each rearmost positioned product of said stack of products.

6. The method as defined in claim 1, further including the steps of:

sliding said products upon each other at a predetermined mobile stacking location; and displacing said mobile stacking location in correspondence to the substantially immobile reclining momentary size of the stack formed.

7. The method as defined in claim 1, further including the steps of:

arranging the products with two opposite ones of their margins extending in a conveying direction; and upwardly bending said products in the region of said margins prior to sliding on said products upon said stack.

8. The method as defined in claim 1, further including the steps of:

infeeding the products in an imbricated formation;

pre-assembling the products infed in said imbricated formation to form packages comprising at least two of said products; and successively sliding said packages upon each other in order to form said stack.

9. The method as defined in claim 8, further including the steps of:

arranging each one of the packages comprising said at least two products so as to possess a rear edge with respect to said predetermined product slide-on direction;

providing entraining elements acting upon said rear edge of each one of said packages; and successively sliding said packages upon each other under the action of said entraining elements.

10. The method as defined in claim 1, further including the steps of:

arranging each one of the products so as to possess a rear edge with respect to said predetermined slide-on direction;

providing entraining elements acting upon said rear edge of each one of said products; and successively sliding said products upon each other under the action of said entraining elements.

11. The method as defined in claim 1, further including the steps of:

successively sliding the products upon each other in order to form a buffer stack;

intermediately storing said products in said buffer stack; and feeding said products from said buffer stack to further processing installations.

12. The method as defined in claim 11, wherein: the step of feeding said products from said buffer stack to further processing installations includes the step of feeding said products to a feeding attachment.

13. An apparatus for producing reclining stacks of flexible, substantially flat products, especially printed products, and having a longitudinal axis extending at most at a slight inclination to the horizontal, comprising:

feeding means for feeding said products and sliding the same during a slide-on operation in a predetermined upward slide-on direction upon each other in order to form a substantially immobile reclining stack defining a rearmost positioned product and a next following product;

pressing means acting upon each said rearmost positioned product at a predetermined pressing location during said slide-on operation;

said pressing location being located during said slide-on operation in front of a leading edge defined by said next following product in said predetermined upward product slide-on direction thereof; and said pressing location being displaceable conjointly with said next following product in said predetermined upward product slide-on direction thereof during the slide-on operation.

14. The apparatus as defined in claim 13, wherein said stack forms a lying stack in which the products forming said stack are arranged in juxtaposed relationship.

15. The apparatus as defined in claim 14, wherein:

said feeding means feed the products in a substantially horizontal direction; and said feeding means deflecting the products for sliding the same upon each other.

16. The apparatus as defined in claim 15, wherein:

said feeding means feed the products in an imbricated formation.

17. The apparatus as defined in claim 15, wherein:

said feeding means deflect the products in an upward direction for sliding the same upon each other.

18. The apparatus as defined in claim 13, wherein:

said pressing means comprise a plurality of pressing elements revolving along a path of revolution; and said pressing elements engaging said rearmost positioned product of said stack along a predetermined section of said path of revolution of said pressing element.

19. The apparatus as defined in claim 18, wherein:
said plurality of pressing elements revolve along a circular path.

20. The apparatus as defined in claim 18, wherein:
said pressing elements constitute freely rotatable rollers.

21. The apparatus as defined in claim 13, wherein:
said feeding means further comprise a conveyor and define a mobile stacking location;
said conveyor sliding said products upon each other in order to form said immobile reclining stack at said mobile stacking location;
each product defining a trailing edge;
said conveyor comprising at least one conveying element which is synchronously driven to co-circulate with said pressing means;
said conveying element being provided with entraining elements arranged thereat in spaced relationship; and
each said entraining element acting upon said trailing edge of a related one of said products.

22. The apparatus as defined in claim 21, wherein:
said conveyor defines a conveying direction extending substantially parallel relative to the stack of products at least in the region of said mobile stacking location.

23. The apparatus as defined in claim 22, wherein:
each said rearmost positioned product of said immobile reclining stack defines a predetermined plane; and
said transversely extending conveying direction extending approximately normally to said plane defined by a related one of said rearmost positioned product.

24. The apparatus as defined in claim 21, further including:
resetting means;
said entraining elements being supported for pivoting between an entraining position and an inactive position; and
said entraining elements being pivoted from said entraining position into said inactive position by abutting said stack and being reset into said entraining position by means of said resetting means.

25. The apparatus as defined in claim 21, wherein:
said conveyor defines a conveying path; and
said conveying path comprising an ascending part extending towards said mobile stacking location.

26. The apparatus as defined in claim 25, further including:
a guide member comprising an ascending section which defines said ascending part of said conveying path;
said at least one conveying element being arranged at a fixed location and comprising a conveyor-active run;
at least said conveyor-active run of said conveying element extending along said ascending part of said conveying path determined by said guide member;
said stack defining a longitudinal direction; and
said guide member being synchronously displaceable with said pressing means in said longitudinal direction of said stack.

27. The apparatus as defined in claim 26, further including:
a slide at which there are arranged said guide member and said pressing means; and
guide means guiding said slide.

28. The apparatus as defined in claim 27, wherein:
said stack is supported at one end which is opposite said pressing means; and
said pressing means being pressed against said stack at an opposite end thereof.

29. The apparatus as defined in claim 28, wherein:
said guide means extend at an inclination descending towards said stack; and
said pressing means being pressed against said stack under the action of gravity.

30. The apparatus as defined in claim 21, wherein:
said pressing means and said mobile stacking location are automatically conjointly displaceable in correspondence to the size of said stack.

31. The apparatus as defined in claim 13, further including:
abutment means limiting displacement of said products in said predetermined product slide-on direction.

32. The apparatus as defined in claim 13, further including:
blowing means for blowing a gaseous medium between said rearmost positioned product of said stack and said next following product slid thereupon.

33. The apparatus as defined in claim 13, wherein:
said gaseous medium comprises air.

34. The apparatus as defined in claim 21, wherein:
said feeding means feeds said products in an imbricated formation defining a predetermined distance between successive ones of said products; and
said entraining elements provided at said conveyor of said feeding means are arranged in a spaced relationship at a spacing which is greater than said predetermined distance between said products in said imbricated formation.

35. An apparatus for producing stacks of flexible, substantially flat products, especially printed products, comprising:
feeding means for feeding said products and sliding the same during a slide-on operation in a predetermined slide-on direction upon each other in order to form a stack defining a rearmost positioned product and a next following product;
pressing means acting upon each said rearmost positioned product at a predetermined pressing location;
said pressing location being located in front of a leading edge defined by said next following product in said predetermined product slide-on direction thereof;
said pressing location being displaceable conjointly with said next following product in said predetermined product slide-on direction thereof during the slide-on operation;
said feeding means further comprise a conveyor and define a stacking location;
said conveyor sliding said products upon each other in order to form said stack at said stacking location;
each product defining a trailing edge;
said conveyor comprising at least one conveying element which is synchronously driven to co-circulate with said pressing means;

said conveying element being provided with entraining elements arranged thereat in spaced relationship;

each said entraining element acting upon said trailing edge of a related one of said products;

said conveyor defines a conveying path;

said conveying path comprising an ascending part extending towards said stacking location;

a guide member comprising an ascending section which defines said ascending part of said conveying path;

said at least one conveying element being stationarily arranged and comprising a conveyor-active run;

at least said conveyor-active run of said conveying element extending along said ascending part of said conveying path determined by said guide member;

said stack defining a longitudinal direction; and said guide member being synchronously displaceable with said pressing means in said longitudinal direction of said stack.

36. The apparatus as defined in claim 35, further including:

a slide at which there are arranged said guide member and said pressing means; and guide means guiding said slide.

37. The apparatus as defined in claim 36, wherein:

said stack is supported at one end which is opposite said pressing means; and said pressing means being pressed against said stack at an opposite end thereof.

38. The apparatus as defined in claim 37, wherein:

said guide means extend at an inclination descending towards said stack; and said pressing means being pressed against said stack under the action of gravity.

39. The apparatus as defined in claim 35, further including:

bending means operatively associated with said conveyor;

said conveyor defining a conveying direction;

said products defining margins extending in said conveying direction while said products are fed by said conveyor; and said bending means being arrangeable to act upon said margins of said products while they are fed by said conveyor in order to upwardly bend said margins of said products while they are fed by said conveyor towards said stacking location.

40. The apparatus as defined in claim 39, wherein:

said bending means comprise lateral guiding elements;

said products define a path of movement; and said lateral guiding elements being arranged in said path of movement of said products and act upon said margins of said product.

41. The apparatus as defined in claim 40, wherein:

said guide member determining said ascending part of said conveying path, contains a support which extends along said ascending part of said conveying path;

each said product defining a central portion supported at said support;

each said guiding element comprising a guide surface at least partially extending above said support; and said products running up with said margins thereof on said guide surface during their movement along said path of movement.

42. The apparatus as defined in claim 40, wherein:

said lateral guiding elements of said bending means are arranged in an ascending part of a conveying path defined by said conveyor.

43. The apparatus as defined in claim 42, further including:

stop means arranged in the region of said ascending part of said conveying path defined by said conveyor; and said stop means acting upon products which rearwardly slide along said ascending part of said conveying path.

44. The apparatus as defined in claim 43, wherein:

said ascending part of said conveying path defines a start portion thereof; and said stop means being arranged at said start portion of said ascending part.

45. A method of producing reclining stacks of flexible, substantially flat products, and having a longitudinal axis extending at most at a slight inclination to the horizontal, especially printed products, comprising the steps of:

successively sliding the products upon each other in order to form a reclining stack defining a rearmost positioned product of said reclining stack and during such operation, sliding a next following product defining a leading edge upon each said rearmost positioned product of said reclining stack in a predetermined upward product slide-on direction;

during said step of sliding on each said next following product, pressing said reclining stack at each said rearmost positioned product of said reclining stack and at a pressing location which is located in front of said leading edge of said next following product in said predetermined upward product slide-on direction;

during the step of sliding-on each said next following product, sliding each said next following product upon each said rearmost positioned product of said reclining stack in substantially unpressurized condition; and displacing said pressing location conjointly with each said next following product as the next following product is slid upon said rearmost positioned product of said reclining stack in said predetermined upward product slide-on direction.

46. An apparatus for producing reclining stacks of flexible, substantially flat products, especially printed products, and having a longitudinal axis extending at most at a slight inclination to the horizontal, comprising:

feeding means for feeding said products and sliding the same during a slide-on operation in a predetermined upward slide-on direction upon each other in order to form a reclining stack defining a rearmost positioned product and a next following product;

pressing means acting upon each said rearmost positioned product at a predetermined pressing location during said slide-on operation;

said pressing location being located during said slide-on operation in front of a leading edge defined by said next following product in said predetermined upward product slide-on direction thereof;

said next following product being in a substantially unpressurized condition during said slide-on operation; and said pressing location being displaceable conjointly with said next following product in said predetermined upward product slide-on direction thereof during the slide-on operation.

47. A method of producing reclining stacks of flexible, substantially flat products, especially printed products, and having a longitudinal axis extending at most at a slight inclination to the horizontal, comprising the steps of:

successively sliding the products upon each other in order to form a substantially immobile reclining stack defining a rearmost positioned product of said reclining stack and during such operation, sliding a next following product defining a leading edge upon each said rearmost positioned product of said reclining stack in a predetermined upwardly directed product slide-on direction;

during said step of sliding on each said next following product, pressing said reclining stack at each said rearmost positioned product of said reclining stack and at a pressing location which is located in front of said leading edge of said next following product in said predetermined upwardly directed product slide-on direction; and displacing said pressing location conjointly with each said next following product as the next following product is slid upon said rearmost positioned product of said reclining stack in said predetermined upwardly directed product slide-on direction;

said step of successively sliding the products upon each other entailing sliding said products upon each other at a predetermined mobile stacking location; and displacing said mobile stacking location in correspondence to the momentary size of the stack formed.

48. An apparatus for producing reclining stacks of flexible, substantially flat products, especially printed products, and having a longitudinal axis extending at most at a slight inclination to the horizontal, comprising:

feeding means for feeding said products and sliding the same during a slide-on operation in a predetermined upon slide-on direction upon each other in order to form a substantially immobile reclining stack defining a rearmost positioned product and a next following product;

pressing means acting upon each said rearmost positioned product at a predetermined pressing location during said slide-on operation;

said pressing location being located during said slide-on operation in front of a leading edge defined by said next following product in said predetermined upward product slide-on direction thereof; and said pressing location being displaceable conjointly with said next following product in said predetermined upward product slide-on direction thereof during the slide-on operation; and said pressing means and said mobile stacking location being automatically conjointly displaceable in correspondence to the size of said stack.

* * * * *

UNITED STATES PATENT AND TRADEMARK OFFICE

CERTIFICATE OF CORRECTION

PATENT NO. : 4,657,237

DATED : April 14, 1987

INVENTOR(S) : EGON HäNSCH

It is certified that error appears in the above-identified patent and that said Letters Patent is hereby corrected as shown below:

Column 6, line 40, please delete "passing" and insert --pressing--

Column 11, line 26, delete "comprising" and insert --comprises--

Column 11, line 31, delete "element" and insert --elements--

Column 13, line 26, delete "A" and insert --The--

Column 13, line 34, delete "defining" and insert --deflecting--

Column 16, line 31, delete "13" and insert --32--

Signed and Sealed this

Twenty-second Day of September, 1987

*Attest:*

DONALD J. QUIGG

*Attesting Officer* *Commissioner of Patents and Trademarks*